US008681050B2

(12) United States Patent
Thornwall et al.

(10) Patent No.: US 8,681,050 B2
(45) Date of Patent: Mar. 25, 2014

(54) HOLLOW CELL CRLH ANTENNA DEVICES

(75) Inventors: Shane Thornwall, San Diego, CA (US); Norberto Lopez, San Diego, CA (US); Vaneet Pathak, San Diego, CA (US); Nan Xu, San Diego, CA (US)

(73) Assignee: Tyco Electronics Services GmbH (CH)

( * ) Notice: Subject to any disclaimer, the term of this patent is extended or adjusted under 35 U.S.C. 154(b) by 235 days.

(21) Appl. No.: 13/078,431

(22) Filed: Apr. 1, 2011

(65) Prior Publication Data

US 2011/0241946 A1 Oct. 6, 2011

Related U.S. Application Data

(60) Provisional application No. 61/320,481, filed on Apr. 2, 2010.

(51) Int. Cl.
*H01Q 1/38* (2006.01)

(52) U.S. Cl.
USPC ..... 343/700 MS; 343/720

(58) Field of Classification Search
USPC ..... 343/700 MS, 720, 850
See application file for complete search history.

(56) References Cited

U.S. PATENT DOCUMENTS

| | | | |
|---|---|---|---|
| 5,511,238 | A | 4/1996 | Bayraktaroglu |
| 6,366,254 | B1 | 4/2002 | Sievenpiper et al. |
| 6,512,494 | B1 | 1/2003 | Diaz et al. |
| 6,525,695 | B2 | 2/2003 | McKinzie, III |
| 6,545,647 | B1 | 4/2003 | Sievenpiper et al. |
| 6,842,140 | B2 | 1/2005 | Killen et al. |
| 6,859,114 | B2 | 2/2005 | Eleftheriades et al. |
| 6,943,731 | B2 | 9/2005 | Killen et al. |
| 6,950,069 | B2 | 9/2005 | Gaucher et al. |
| 6,958,729 | B1 | 10/2005 | Metz |
| 7,215,007 | B2 | 5/2007 | McKinzie, III et al. |
| 7,256,753 | B2 | 8/2007 | Werner et al. |
| 7,330,090 | B2 | 2/2008 | Itoh et al. |
| 7,358,915 | B2 | 4/2008 | Legay et al. |
| 7,391,288 | B1 | 6/2008 | Itoh et al. |
| 7,429,961 | B2 | 9/2008 | Sievenpiper et al. |
| 7,446,712 | B2 | 11/2008 | Itoh et al. |
| 7,463,213 | B2 | 12/2008 | Nakano et al. |
| 7,592,957 | B2 | 9/2009 | Achour et al. |

(Continued)

FOREIGN PATENT DOCUMENTS

| | | | |
|---|---|---|---|
| TW | I401840 | B | 7/2013 |
| WO | WO-2007098061 | A3 | 8/2007 |

(Continued)

OTHER PUBLICATIONS

"U.S. Appl. No. 12/250,477, Non Final Office Action mailed Feb. 15, 2012", 14 pgs.

(Continued)

*Primary Examiner* — Ahshik Kim

(57) ABSTRACT

An antenna device, such as composite right and left handed (CRLH) antenna device, is formed on the substrate, including a ground electrode formed on the substrate. In an example, the antenna device includes a cell patch comprising an enclosed conductive portion formed along an exterior edge of the cell patch, leaving an interior portion of the cell patch to partially expose the substrate. A feed structure is electromagnetically coupled to the cell patch, a via line is coupled to the ground electrode, and a via couples the via line to the cell patch.

20 Claims, 12 Drawing Sheets

(56) References Cited

U.S. PATENT DOCUMENTS

| | | | | |
|---|---|---|---|---|
| 7,623,083 | B2 * | 11/2009 | Chung | 343/767 |
| 7,764,232 | B2 | 7/2010 | Achour et al. | |
| 7,911,386 | B1 * | 3/2011 | Itoh et al. | 343/700 MS |
| 7,932,863 | B2 | 4/2011 | Pros et al. | |
| 7,952,526 | B2 | 5/2011 | Lee et al. | |
| 2003/0011522 | A1 | 1/2003 | McKinzie, III et al. | |
| 2004/0075617 | A1 | 4/2004 | Lynch et al. | |
| 2004/0113848 | A1 | 6/2004 | Gaucher et al. | |
| 2004/0227668 | A1 | 11/2004 | Sievenpiper | |
| 2005/0225492 | A1 | 10/2005 | Metz | |
| 2005/0253667 | A1 | 11/2005 | Itoh et al. | |
| 2007/0176827 | A1 | 8/2007 | Itoh et al. | |
| 2008/0001684 | A1 | 1/2008 | Itoh et al. | |
| 2008/0048917 | A1 | 2/2008 | Achour et al. | |
| 2008/0204327 | A1 | 8/2008 | Lee et al. | |
| 2008/0231521 | A1 | 9/2008 | Anguera Pros et al. | |
| 2008/0258981 | A1 | 10/2008 | Achour et al. | |
| 2009/0128446 | A1 | 5/2009 | Gummalla et al. | |
| 2009/0135087 | A1 | 5/2009 | Gummalla et al. | |
| 2010/0045554 | A1 | 2/2010 | Xu et al. | |
| 2011/0156963 | A1 * | 6/2011 | Rajgopal et al. | 343/702 |
| 2011/0285602 | A1 * | 11/2011 | Ryou et al. | 343/848 |

FOREIGN PATENT DOCUMENTS

| | | | |
|---|---|---|---|
| WO | WO-2007127955 | A3 | 11/2007 |
| WO | WO-2009049303 | A1 | 4/2009 |
| WO | WO-2009064926 | A1 | 5/2009 |
| WO | WO-2010021854 | A1 | 2/2010 |

OTHER PUBLICATIONS

"U.S. Appl. No. 12/250,477, Preliminary Amendment filed Jan. 28, 2009", 15 pgs.

"U.S. Appl. No. 12/250,477, Response filed May 15, 2012 to Non Final Office Action mailed Feb. 15, 2012", 18 pgs.

"U.S. Appl. No. 12/250,477, Restriction Requirement mailed Aug. 15, 2011", 6 pgs.

"U.S. Appl. No. 12/270,410 , Response filed Feb. 7, 2012 to Final Office Action mailed Nov. 7, 2011", 23 pgs.

"U.S. Appl. No. 12/270,410, Advisory Action mailed Feb. 24, 2012", 4 pgs.

"U.S. Appl. No. 12/270,410, Final Office Action mailed Nov. 7, 2011", 18 pgs.

"U.S. Appl. No. 12/270,410, Non Final Office Action mailed May 12, 2011", 20 pgs.

"U.S. Appl. No. 12/270,410, Response filed Mar. 21, 2011 to Restriction Requirement mailed Feb. 17, 2011", 22 pgs.

"U.S. Appl. No. 12/270,410, Response filed Sep. 12, 2011 to Non Final Office Action mailed May 12, 2011", 26 pgs.

"U.S. Appl. No. 12/270,410, Restriction Requirement mailed Feb. 17, 2011", 6 pgs.

"U.S. Appl. No. 12/536,422 , Response filed May 17, 2012 to Non Final Office Action mailed Feb. 17, 2012", 12 pgs.

"U.S. Appl. No. 12/536,422, Non Final Office Action mailed Feb. 17, 2012", 16 pgs.

"International Application Serial No. PCT/US2008/079753, International Search Report mailed Jan. 29, 2009", 3 pgs.

"International Application Serial No. PCT/US2008/079753, International Written Opinion mailed Jan. 29, 2009", 5 pgs.

"International Application Serial No. PCT/US2008/083455, International Preliminary Report on Patentability mailed May 18, 2010", 5 pgs.

"International Application Serial No. PCT/US2008/083455, International Search Report and Written Opinion mailed Feb. 27, 2009", 11 pgs.

"International Application Serial No. WO2007127955A2, International Search Report mailed Dec. 31, 2009", 3 pgs.

"International Application Serial No. WO2007127955A2, Written Opinion mailed Dec. 31, 2009", 4 pgs.

"Korean Application Serial No. 2010-7011754, Office Action mailed Jan. 21, 2011", w/English Translation, 7 pgs.

"Korean Application Serial No. 2010-7007682, Final Office Action mailed Apr. 25, 2011", w/English Translation, 9 pgs.

"Korean Application Serial No. 2010-7007682, Office Action mailed Jul. 23, 2010", w/English Translation, 14 pgs.

"Korean Application Serial No. 2010-7011754, Office Action mailed Aug. 18, 2010", w/English Translation, 12 pgs.

"Korean Application Serial No. 2010-7011754, Response filed Oct. 18, 2010 to Office Aaction mailed Aug. 18, 2010", English Translation Only, 9 pgs.

"Korean Application Serial No. 2010-7011755, Final Office Action mailed Jan. 21, 2011", w/English Translation, 11 pgs.

"Korean Application Serial No. 2010-7011755, Office Action mailed Aug. 18, 2010", w/English Translation, 16 pgs.

"Korean Application Serial No. 2010-7011755, Response filed Oct. 18, 2010 to Office Action mailed Aug. 18, 2010", English Translation Only, 17 pgs.

"Taiwan Application Serial No. 97139201, Office Action mailed Mar. 22, 2012", w/English Translation, 13 pgs.

"Taiwanese Application Serial No. 97143837, Office Action mailed Sep. 6, 2012", w/English Translation, 16 pgs.

"Taiwanese Application Serial No. 97143837, Response filed Feb. 20, 2013 to Office Action mailed Sep. 6, 2012", w/English Translation, 19 pgs.

Caloz, Christophe, et al., "Array Factor Approach of Leaky-Wave Antennas and Application to 1-D/2-D Composite Right/Left-Handed (CRLH) Structures", IEEE Microwave and Wireless Components Letters, vol. 14 No. 6, (Sep. 2004), 4 pgs.

Caloz, Christophe, et al., "Electromagnetic Metamaterials: Transmission Line Theory and Microwave Applications", John Wiley & Sons, (2006), 186 pgs.

Choi, S H, et al., "A new ultra-wideband antenna for UWB applications", Microwave and Optical Technology Letters, 40(5), (Mar. 5, 2004), 399-401.

Damm, C., et al., "Artificial Line Phase Shifter with separately tunable Phase and Line Impedance", 36th European Microwave Conference, (2006), 423-426.

Gummalla, et al., "U.S. Appl. No. 61/091,203, Information Disclosure Statement mailed Aug. 22, 2008", Metamaterial Antenna Structures with Non-Linear Coupling Geometry.

Herraiz-Martinez, Francisco Javier, et al., "Multi-frequency microstrip patch antennas based on metamaterial structures", IEEE Antennas and Propagation Society International Symposium 2007, (2007), 3484-3487.

Horii, Y, et al., "Super Compact Multilayered Left-Handed Transmission Line and Diplexer Application", IEEE Transactions on Microwave Theory and Techniques, 53(4), (Apr. 2005), 1527-1534.

Huang, W., et al., "Composite Right-Left Handed Metamaterial ultra-wideband antenna", IEEE International Workshop on Antenna Technology, 2009. iWAT 2009., (2009), 1-4.

Itoh, T., "Invited Paper: Prospects for Metamaterials", Electronics Letters 40(16), (Aug. 2004), 972-973.

Kang, M., et al., "Miniaturized MIM CRLH transmission line structure and application to backfire-to-endfire leaky-wave antenna", IEEE Antennas and Propagation Society International Symposium, 2004, vol. 1, (2004), 827-830.

Lai, Anthony, et al., "Inifinite Wavelength Resonant Antennas with Monopolar Radiation Pattern Based on Periodic Structures", IEEE Transactions on Antennas and Propagation, 55(3), (Mar. 2007), 868-876.

Lee, C, et al., "Design of Resonant Small Antenna Using Composite Right/Left-Handed Transmission Line", IEEE Antennas and Propagation Society Intl. Symposium, (Jul. 2005), 218-221.

Liu, C., et al., "Frequency-Scanned Leaky-Wave Antenna from Negative Refractive Index Transmission Lines", 2nd European Conference on Antennas and Propagation (EuCAP 2007), (Nov. 2007), 4 pgs.

Park, Jae-Hyun, et al., "Compact Spiral Zeroth-order Resonance Antenna using metamaterial transmission line", Journal of the Insti-

(56) References Cited

OTHER PUBLICATIONS tute of Electronics Engineers of Korea. TC, Telecommunication, 44(7), University Paper, (2007), 6 pgs.

Pozar, D. M., "Microwave Engineering", 3rd Ed. John Wiley & Sons, (2005), 318-323 & 370.

Sievenpiper, Daniel F., "High-Impedence Electromagnetic Surfaces", Ph.D. Dissertation, University of California, Los Angeles, (1999), 162 pgs.

Simion, S., et al., "CPW Antenna Fabricated on Silicon Substrate, Based on Transmission Line Metamaterial Approach", ICEAA 2007. International Conference on Electromagnetics in Advanced Applications, 2007., (2007), 488-491.

Tong, W, et al., "Dual Composite Right/Left-Handed (D-CRLH) Transmission Line in GaAs MMIC Technology", International Workshop on Antenna Technology: Small and Smart Antennas Metamaterials and Applications, 2007. IWAT '07., (2007), 105-108.

Wu, Chien-Hung, et al., "A novel small planar antenna utilizing cascaded right/left-handed transmission lines", 2007 IEEE Antennas and Propagation Society International Symposium, (2007), 1889-1892.

* cited by examiner

HOLLOW CELL CRLH ANTENNA DEVICES

PRIORITY CLAIMS AND RELATED APPLICATIONS

This application claims priority under 35 U.S.C. 119(e) to U.S. Patent Application Ser. No. 61/320,481, entitled "HOLLOW CELL CRLH ANTENNA DEVICES" and filed on Apr. 2, 2010, which is incorporated herein by reference in its entirety.

BACKGROUND

The present invention relates to Radio Frequency (RF) antennas. Wireless device performance is limited by the operation of the radiator, antenna. Designers seek to optimize the antenna operation while decreasing the size or footprint of the wireless device.

DESCRIPTION

Figure 1A:
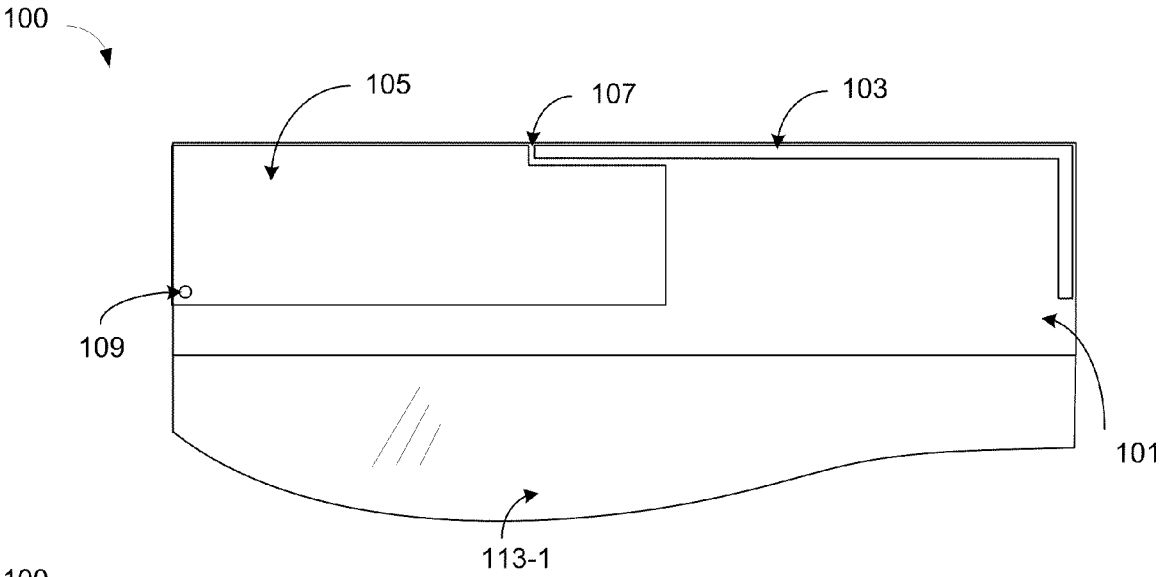
FIGS. 1A-1B illustrate an example of a CRLH antenna device having a cell patch, wherein the cell patch includes a conductive polygon structure, according to an example embodiment.

This application relates to antenna structures and specifically antenna structures based on metamaterial designs.

The propagation of electromagnetic waves in most materials obeys the right-hand rule for the (E, H, β) vector fields, which denotes the electrical field E, the magnetic field H, and the wave vector β (or propagation constant). In these materials, the phase velocity direction is the same as the direction of the signal energy propagation (group velocity) and the refractive index is a positive number. Such materials are referred to as Right/Handed (RH) materials. Most natural materials are RH materials, but artificial materials may also be RH materials.

A metamaterial (MTM) is an artificial structure which behaves differently from a natural RH material alone. Unlike RH materials, a metamaterial may exhibit a negative refractive index, wherein the phase velocity direction is opposite to the direction of the signal energy propagation where the relative directions of the (E, H, β) vector fields follow a left-hand rule. When a metamaterial is designed to have a structural average unit cell size ρ which is much smaller than the wavelength of the electromagnetic energy guided by the metamaterial, the metamaterial behaves like a homogeneous medium to the guided electromagnetic energy. Metamaterials that support only a negative index of refraction with permittivity ∈ and permeability μ being simultaneously negative are pure Left Handed (LH) metamaterials.

A metamaterial structure may be a combination or mixture of an LH metamaterial and an RH material; these combinations are referred to as Composite Right and Left Hand (CRLH) metamaterials. A CRLH metamaterial behaves like an LH metamaterial under certain conditions, such as for operation at low frequencies; the same CRLH metamaterial may behave like an RH material under other conditions, such as operation at high frequencies.

Implementations and properties of various CRLH MTMs are described in, for example, Caloz and Itoh, "Electromagnetic Metamaterials: Transmission Line Theory and Microwave Applications," John Wiley & Sons (2006). CRLH MTMs and their applications in antennas are described by Tatsuo Itoh in "Invited paper: Prospects for Metamaterials," Electronics Letters, Vol. 40, No. 16 (August, 2004).

CRLH MTMs may be structured and engineered to exhibit electromagnetic properties tailored to specific applications. Additionally, CRLH MTMs may be used in applications where other materials may be impractical, infeasible, or unavailable to satisfy the requirements of the application. In addition, CRLH MTMs may be used to develop new applications and to construct new devices that may not be possible with RH materials and configurations.

As used in this application, MTM and CRLH MTM structures and components are based on a technology called "Metamaterial" which applies the concept of Right-handed and Left-handed (LH) structures.

As used herein, the term "Metamaterial," "MTM," "CRLH," and "CRLH MTM" refer to technology and technical means, methods, devices, inventions and engineering works which allow compact devices composed of conductive and dielectric parts and are used to receive and transmit electromagnetic waves and behave as unique structures which are much smaller than the free space wavelength of the propagating electromagnetic waves. Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of the following structures to design, integrate, and optimize antennas and RF components inside wireless communications devices.

Composite Right Left Handed (CRLH) structures exhibit simultaneous negative permittivity (∈) and permeability (μ) within certain frequency bands and simultaneous positive ∈ and μ within other frequency bands.

Transmission-Line (TL) based CRLH structures enable TL propagation and exhibit simultaneous negative permittivity (∈) and permeability (μ) within certain operating frequency bands and simultaneous positive ∈ and μ within other operating frequency bands TL-based Left-Handed (TL-LH) structures enable TL propagation and exhibit simultaneous negative ∈ and μ within certain frequency bands and simultaneous positive ∈ and μ within extremely high-frequency non operating bands.

Combination of the above may be designed and built incorporating conventional RF design structures. Antennas, RF components and other devices may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMICC, flexible films, plastic or even paper.

As wireless devices continue to shrink and pack more integrated components, the space available for layout of the various antenna structures of the device can be challenging to meet certain layout constraints such as device enclosure size and dimensions. Integrated peripheral components may include, for example, a microphone, a speaker, a camera, or a vibe motor. In some cases, it may be necessary to reroute connection lines or modify the shape of certain components for incorporation into a device design. Rerouting connection lines and adapting the shape and size of the components provide some relief and additional space savings necessary to meet these layout constraints. However, as the devices continue to get shrink, rerouting lines and adapting the shape may not be enough to meet progressively smaller design requirements, especially in compact wireless devices that are formed on a single printed circuit board (PCB) substrate. Thus, alternative and novel designs and methods of producing antenna structures that can maximize the use of a limited area may be of increasing interest as the layout constraints continue to shrink.

A CRLH MTM design may be used in a variety of applications, including wireless and telecommunication applications. The use of a CRLH MTM design for elements within a wireless application often reduces the physical size of those elements and improves the performance of these elements. In some embodiments, CRLH MTM structures are used for antenna structures and other RF components.

CRLH MTM structures may be used in wireless devices having a variety of features, antenna structures and elements. CRLH structures provide several benefits for constructing a compact antenna while supporting a broad range of frequencies. Some of these structures are described in the U.S. patent application Ser. No. 12/270,410 entitled "Metamaterial Structures with Multilayer Metallization and Via," filed on Nov. 13, 2008, the disclosure of which is incorporated herein by reference. CRLH structures may include conductive elements such as, for example, a feed structure, a launch pad, a cell patch, a via, a via line. The conductive elements may take on a variety of geometrical shapes and dimensions to meet certain design requirements as described in U.S. patent application Ser. No. 12/270,410. For example, the cell patch may be rectangular, polygonal, irregular, circular, oval, or combination of different shapes. The via line and the feed line can be polygonal, irregular, zigzag, spiral, meander or combination of different shapes. The launch pad can be rectangular, polygonal, irregular, circular, oval, or combination of different shapes. Although various elements of the CRLH structure can be designed to meet the space limitations within the compact wireless device, placement of the integrating peripheral components proximate the CRLH structure can nevertheless be challenging, especially in designs which limit the placement of the peripheral components to a predetermined or fixed location. Thus, smaller integrated wireless devices may benefit from the use of alternative CRLH designs and techniques that offer improved integration as well as size reduction. Such CRLH designs may include, for example, a hollow cell patch, which may be in the form of a polygon, structured to have an exterior conductive portion and a non-conductive interior portion; a meandered line formed within the interior of the hollow cell patch design; and a cell patch ring formed along the periphery and side wall of a substantially circular structure defined by an opening in the PCB substrate. In addition, other designs may include a combination of multiple CRLH antenna structures distributed over the main PCB substrate and the elevated PCB substrates, supporting multiple frequency bands.

Figure 1B:
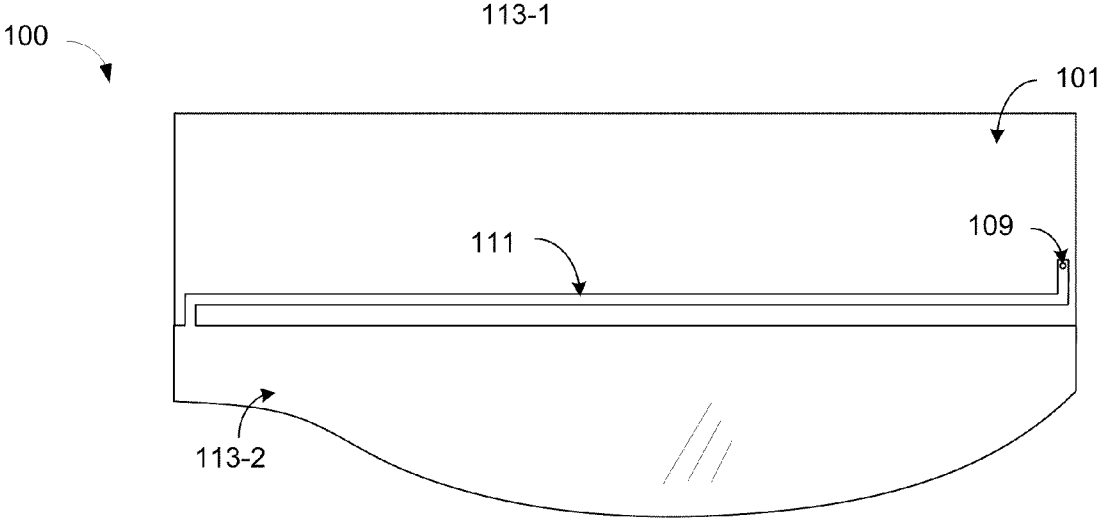

FIGS. 1A-1B illustrate a top view of a top and bottom layer, respectively, of a CRLH antenna device 100, according to an first example embodiment. In FIGS. 1A-1B, portions of a CRLH structure may include several conductive elements formed on a substrate 101. The substrate 100 may be a Printed Circuit Board (PCB) or other dielectric material. The conductive elements may include, for example, a feed line 103 configured to receive an RF signal, a cell patch 105 capacitively coupled to the feed line 103 through a coupling gap 107, a via 109, which is formed in the substrate 101, coupling the cell patch 105 to a via line 109, which terminates to a ground electrode 113, including a top ground 113-1 and a bottom ground 113-2 which are connected together by an array of vias (not shown).

In operation, the CRLH antenna device 100 may include a series inductor LR, a series capacitor CL, a shunt inductor LL and a shunt capacitor CR where LL and CL determine a left-handed (LH) mode propagation properties and LR and CR determine a right-handed (RH) mode propagation properties. Certain structural elements contribute to forming LR, CR, LL, and CL that govern the RH and LH modes, respectively. For example, the coupling gap 107 formed between the feed line 103 and the cell patch 105 may generate the series capacitance CL, the via line 111 may produce the shunt inductor LL, while the LR may be attributed to a current propagation along the cell patch 105, and CR is due to the substrate 101 being sandwiched between the cell patch 105 and the via line 109.

Figure 2A:
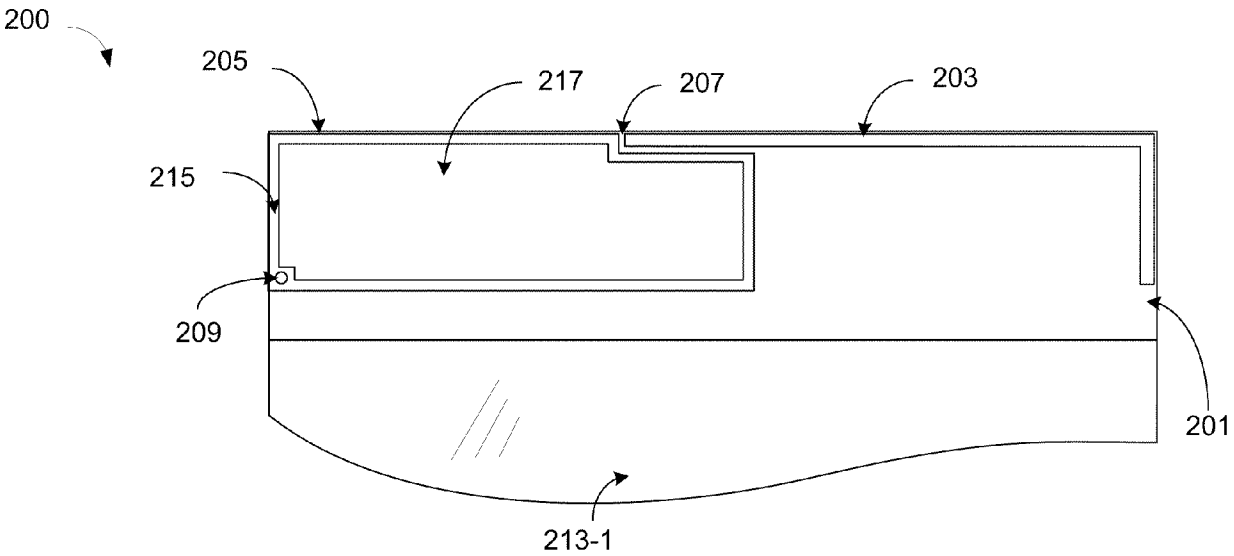
FIGS. 2A-2B illustrate an example of a CRLH antenna device having a cell patch, wherein portions of the cell patch include a polygon structure having a hollow interior portion and a conductive exterior portion, according to an example embodiment.
Figure 2B:
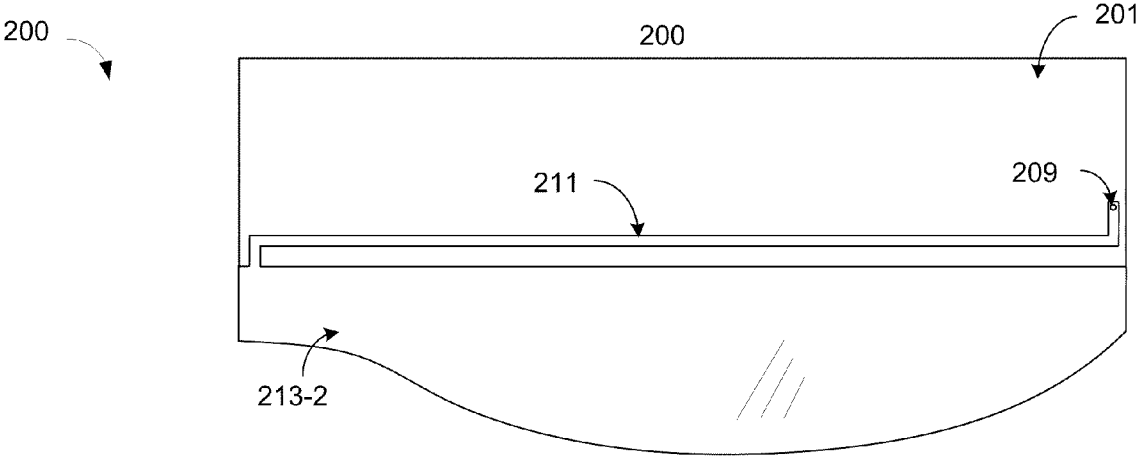

FIGS. 2A-2B illustrate a top view of a top and bottom layer, respectively, of a CRLH antenna device 200 having a hollow cell patch design, according to a second example embodiment. In FIGS. 2A-2B, portions of a CRLH structure may include several conductive elements that are formed on a substrate 201. The conductive elements may include, for example, a feed line 203 configured to receive an RF signal, a cell patch 205 capacitively coupled to the feed line 203 through a coupling gap 207, a via 209, which is formed in the substrate 201, coupling the cell patch 205 to a via line 209, which terminates to a ground electrode 213, including a top ground 213-1 and a bottom ground 213-2 which are connected together by an array of vias (not shown).

According to this embodiment, the cell patch 205 is designed to have structural features that mimic the cell patch 105 of the first embodiment, having a similar polygon shape and similar dimensions. However, in the second example embodiment, the cell patch 205 is structured to include an enclosed conductive portion 215 formed along the exterior edge of the cell patch 205, leaving an interior portion 217 of the cell patch 205 to partially expose the substrate 201. In other words, the enclosed conductive portion 215 of the cell patch 205 forms an opening or "hollow" interior 217 to the substrate 201, freeing up valuable real estate for the inclusion of other components. Therefore, the CRLH antenna device 200, with the hollow interior cell patch design, offers the advantage of providing additional room on the PCB for implementing integrated components such as, for example, a microphone, a speaker, a camera, or a vibe motor.

In operation, the CRLH antenna device 200 may include a series inductor LR, a series capacitor CL, a shunt inductor LL and a shunt capacitor CR where LL and CL determine left-handed (LH) resonance mode propagation properties and LR and CR determine right-handed (RH) resonance mode propagation properties. Certain structural elements contribute to forming LR, CR, LL, and CL that govern the RH and LH modes, respectively. For example, the coupling gap 207 formed between the feed line 203 and the cell patch 205 may generate the series capacitance CL, the via line 211 may produce the shunt inductor LL, while the LR may be attributed to a current propagation along the cell patch 205, and CR is due to the substrate 201 being sandwiched between the cell patch 205 and the via line 209. The effect of the hollowing out the interior of the cell patch 205 in the second embodiment may result in reducing CR and thus may have the benefit of increasing the bandwidth of the LH resonance. A shift in both LH and RH resonances may also occur, as LR and CL are also governed by the properties of the cell patch 205. By modifying the size and shape of certain structural elements in the CRLH antenna device 200, the LH and RH resonances may be compensated or tuned to match the resonances of the previous antenna device 100, as presented in the next embodiment.

Figure 3A:
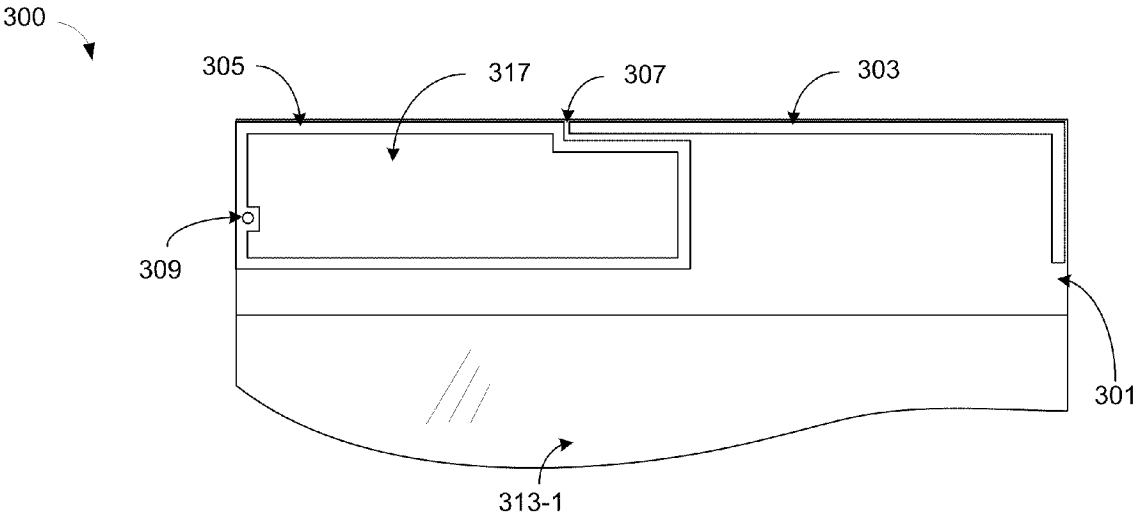
FIGS. 3A-3B illustrate an example of a tuned CRLH antenna device having a cell patch, wherein portions of the cell patch include a polygon structure having a hollow interior portion and a conductive exterior portion, according to an example embodiment.
Figure 3B:
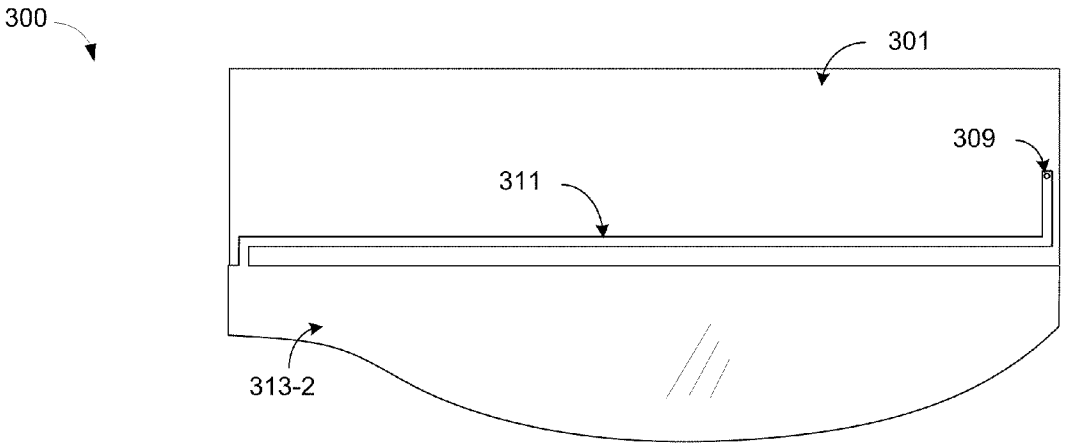

FIGS. 3A-3B illustrate a top view of a top and bottom layer, respectively, of a CRLH antenna device 200 having a tuned hollow cell patch design, according to a third example embodiment. In FIGS. 3A-3B, portions of a CRLH structure may include several conductive elements that are formed on a substrate 301. The conductive elements may include, for example, a feed line 303 configured to receive an RF signal, a cell patch 305 capacitively coupled to the feed line 303 through a coupling gap 307, a via 309, which is formed in the substrate 301, coupling the cell patch 305 to a via line 311, which terminates to a ground electrode 313, including a top ground 313-1 and a bottom ground 313-2 which are connected together by an array of vias (not shown).

According to this embodiment, the cell patch 305 is designed to include structural features that mimic the cell patch 305 of the second embodiment, having a similar hollow cell interior design, polygon shape and similar dimensions. However, in the third example embodiment, the via line 311 is extended to increase its total length in order to tune the LH and RH resonances to better match the resonances of the CRLH antenna device 100. In other words, in order to tune the CRLH antenna device 200 to fall in the same frequency as the CRLH antenna device 300, the via line 311 was extended in length to maintain the same size cell and have a fair comparison between the two CRLH antenna devices 100 and 300.

Figure 5:
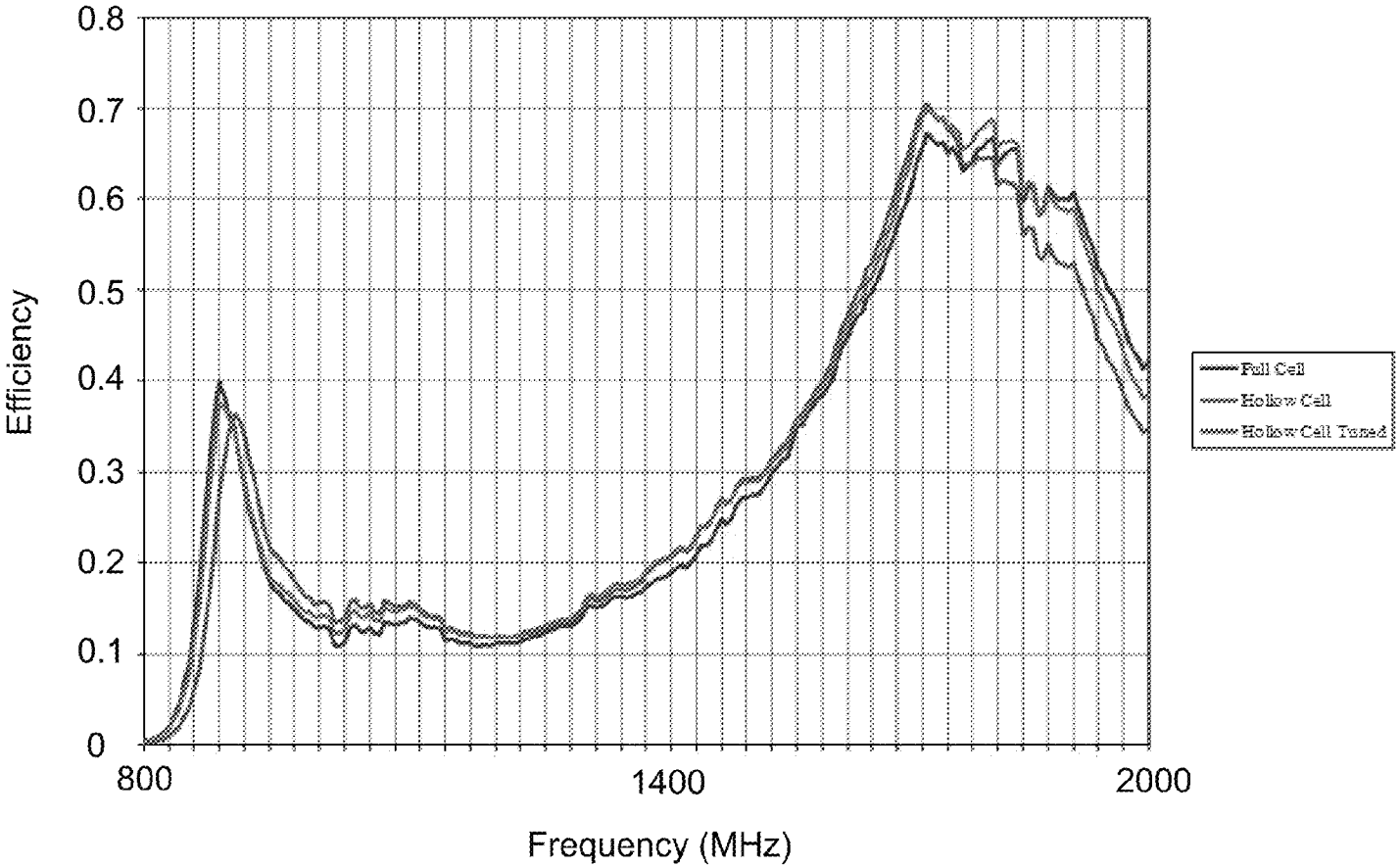
FIGS. 5-6 illustrate measured efficiency plots of the CRLH antenna devices as in FIGS. 1-3, according to an example embodiment.
Figure 6:
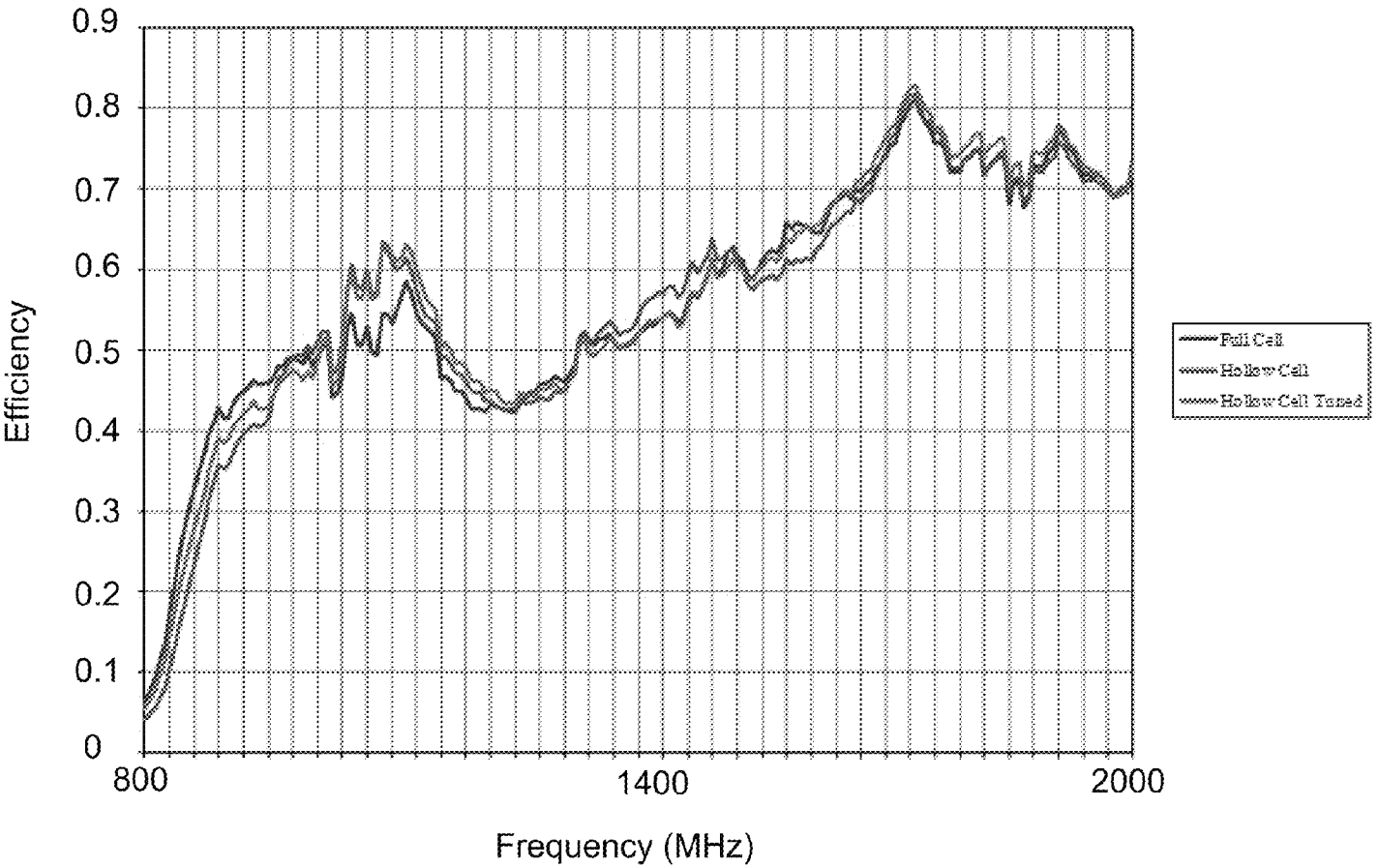

In operation, the CRLH antenna device 300 may include a series inductor LR, a series capacitor CL, a shunt inductor LL and a shunt capacitor CR where LL and CL determine left-handed (LH) resonance mode propagation properties and LR and CR determine right-handed (RH) resonance mode propagation properties. Certain structural elements contribute to forming LR, CR, LL, and CL that govern the RH and LH modes, respectively. For example, the coupling gap 307 formed between the feed line 303 and the cell patch 305 may generate the series capacitance CL, the via line 311 may produce the shunt inductor LL, while the LR may be attributed to a current propagation along the cell patch 305, and CR is attributed to the substrate 301 being sandwiched between the cell patch 305 and the via line 309. In the third embodiment, the extended via line 309 results in an improved matching between the original CRLH antenna device 100 and the tuned hollow cell CRLH antenna device 300. The return loss and efficiency results of the three CRLH antenna devices are illustrated in FIGS. 4-6.

Figure 4:
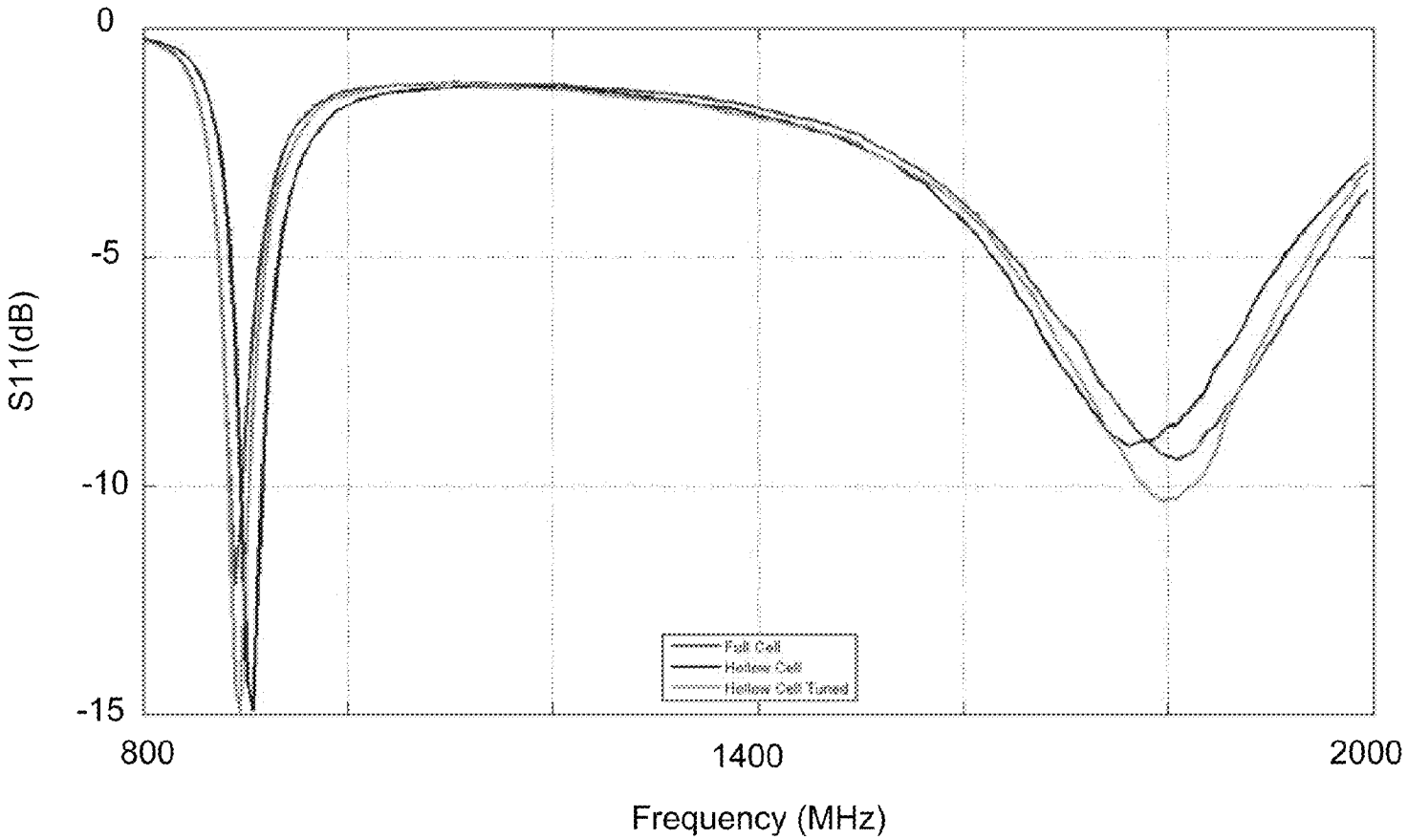
FIG. 4 illustrates a measured return loss plot of the CRLH antenna devices as in FIGS. 1-3, according to an example embodiment.

According to FIG. 4, under equal conditions, the CRLH antenna device 200 falls about 20 MHz higher in frequency vs. the CRLH antenna device 100. At 890 MHz (peak frequency of CRLH antenna device 100 and CRLH antenna device 300, we can see from the normalized efficiency that the CRLH antenna device 100 has about 5% more efficiency.

Other variations of hollow cell patch designs include a hollow cell patch with an extended stub, a meander hollow cell patch, an inverted meander cell patch, a cell patch hole, and a multi-hollow cell patch design. These and many more designs of various hollow cell patch structures are presented in the ensuing examples.

Figure 7A:
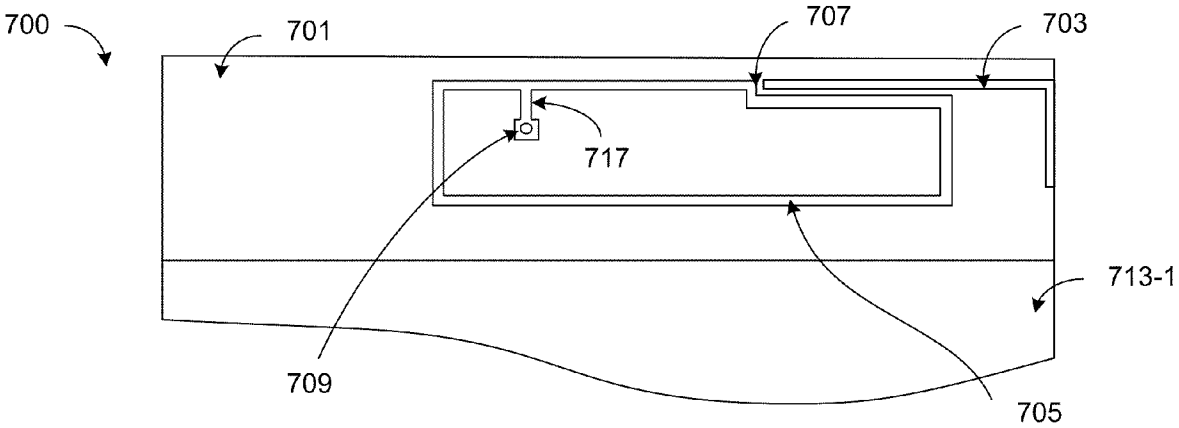
FIGS. 7A-7B illustrate a top view of a top and bottom layer, respectively, of a CRLH antenna device having a hollow cell patch design with an extended stub, according to an example embodiment.
Figure 7B:
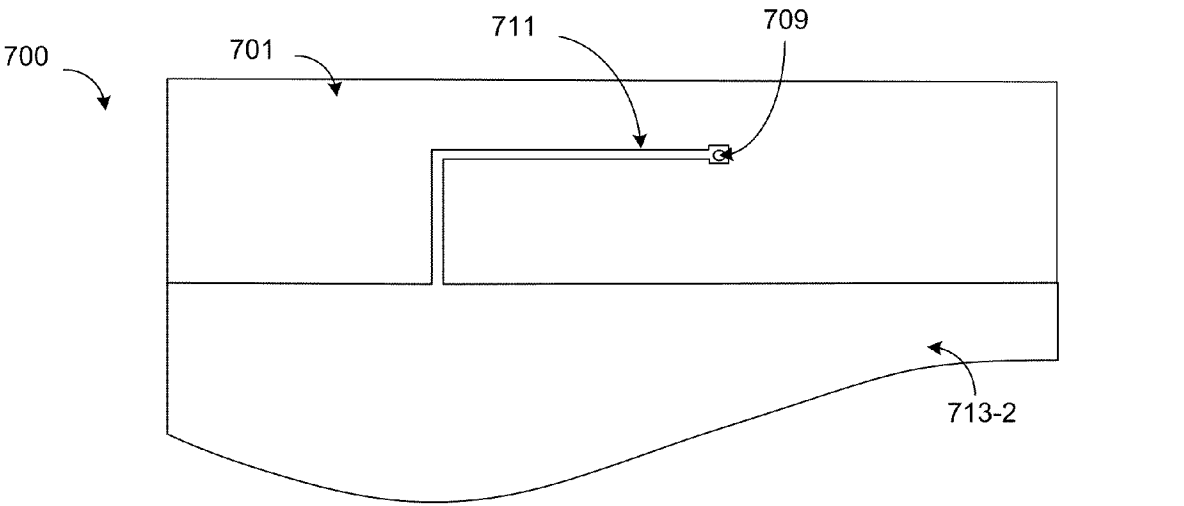

FIGS. 7A-7B illustrate a top view of a top and bottom layer, respectively, of a CRLH antenna device 700 having a hollow cell patch design with an extended stub, according to a fourth example embodiment. In FIGS. 7A-7B, portions of a CRLH structure may include several conductive elements that are formed on a substrate 701. The conductive elements may include, for example, a feed line 703 configured to receive an RF signal, a cell patch 705 capacitively coupled to the feed line 703 through a coupling gap 707, an extended stub 717 coupling the cell patch 705 to a via 709, which is formed in the substrate 701, a via line 711 connected to the via 709, and a ground electrode 713, including a top ground 713-1 and a bottom ground 713-2 which are connected together by an array of vias (not shown), coupled to and terminating the via line 711.

Depending on the tuning or matching requirements, the via line 711 may be extended or reduced in length and configured in a variety of shapes to influence the shunt inductor LL. To properly connect the cell patch 705 to a desired configuration of the via line 711, the extended stub 717 may be positioned anywhere along the interior conductive edge of the cell patch 705 and structured in a variety of lengths and shapes to align and couple to the via line 711.

Figure 8A:
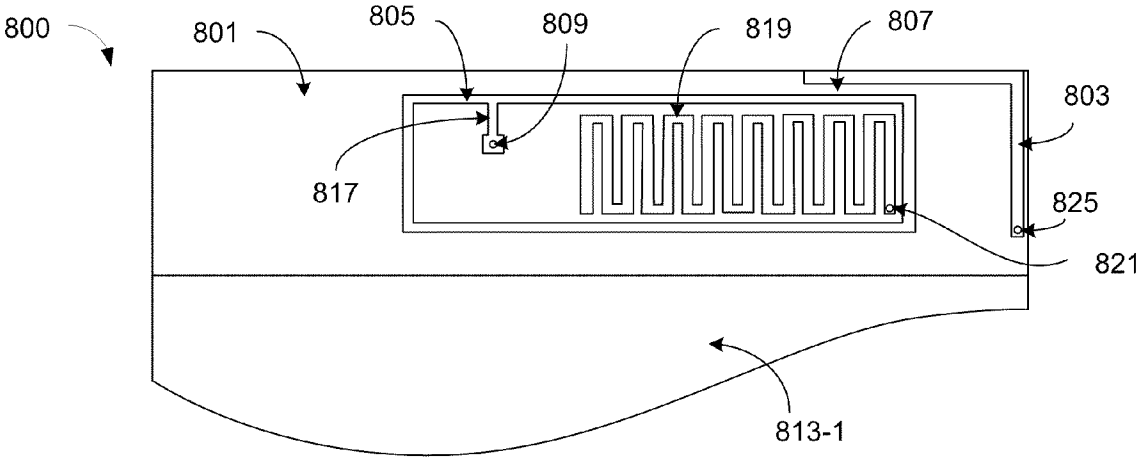
FIGS. 8A-8B illustrate a top view of a top and bottom layer, respectively, of a CRLH antenna device having a meander hollow cell patch design, according to a example embodiment.
Figure 8B:
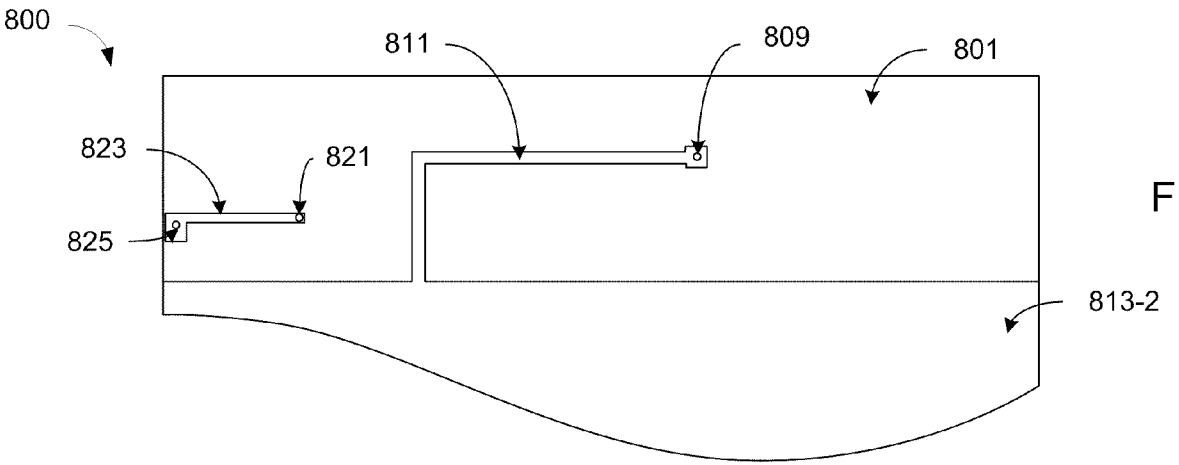

FIGS. 8A-8B illustrate a top view of a top and bottom layer, respectively, of a CRLH antenna device 800 having a meander hollow cell patch design, according to a fifth example embodiment. In FIGS. 8A-8B, portions of a CRLH structure may include several conductive elements that are formed on a substrate 801. The conductive elements may include, for example, a feed line 803 configured to receive an RF signal, a cell patch 805 capacitively coupled to the feed line 803 through a coupling gap 807, a meander conductive line 819 enclosed by the cell patch 805, a first via 821 coupled to a distal end of the meander conductive line 819, a bridge connector 823 coupling the meander conductive line 819 to the feed line 803 through a second via 825, an extended stub 817 coupling the cell patch 805 to a third via 809, a via line 811 connected to the third via 809, and a ground electrode 813, including a top ground 813-1 and a bottom ground 813-2 which are connected together by an array of vias (not shown), coupled to and terminating the via line 811.

According to this embodiment, the hollow cell patch 805 provides additional room within the CRLH antenna device 800 to accommodate the meander conductive line 819 for increasing the total length of the feed line 803, which in turn may produce an extra resonance mode.

Figure 9A:
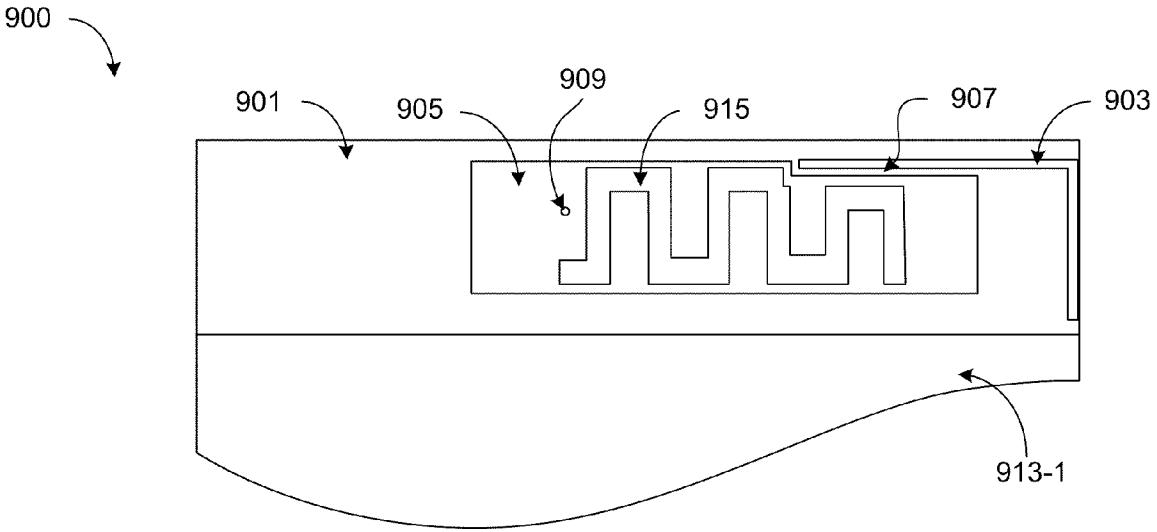
FIGS. 9A-9B illustrate a top view of a top and bottom layer, respectively, of a CRLH antenna device having an inverted meander hollow cell patch design, according to an example embodiment.
Figure 9B:
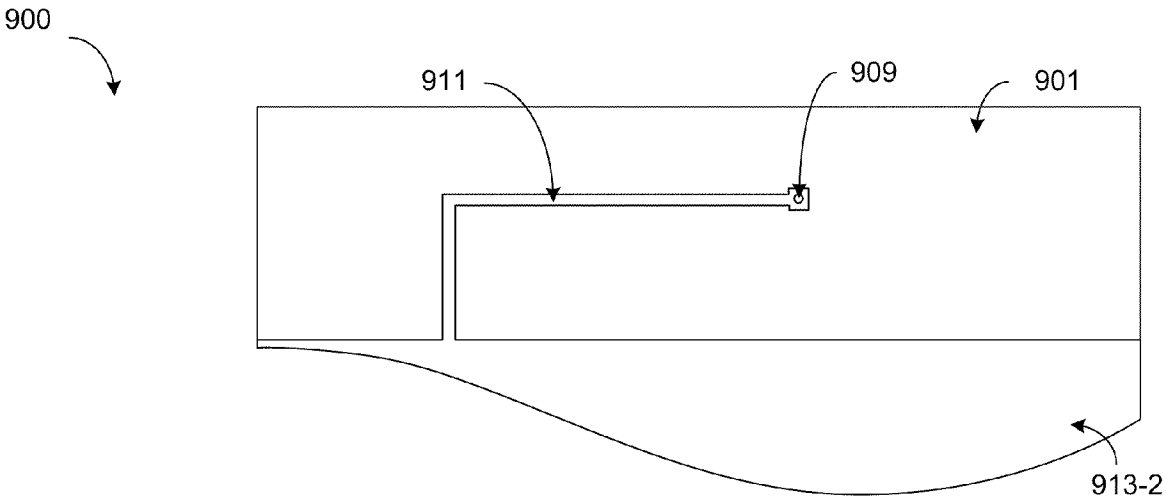

FIGS. 9A-9B illustrate a top view of a top and bottom layer, respectively, of a CRLH antenna device 900 having a inverted meander hollow cell patch design, according to a sixth example embodiment. In FIGS. 9A-9B, portions of a CRLH structure may include several conductive elements that are formed on a substrate 901. The conductive elements may include, for example, a feed line 903 configured to receive an RF signal, a cell patch 905 capacitively coupled to the feed line 903 through a coupling gap 907, an extended stub 917 coupling the cell patch 905 to a via 909, which is formed in the substrate 901, a via line 911 connected to the via 909, and a ground electrode 913, including a top ground 913-1 and a bottom ground 913-2 which are connected together by an array of vias (not shown), coupled to and terminating the via line 911.

According to this embodiment, an opening in the cell patch 905 in the shape of a meander line 915 exposes a portion of the substrate 901, modifying the available conductive area of the cell patch 905, which may affect CR and the bandwidth in the LH mode.

Figure 10:
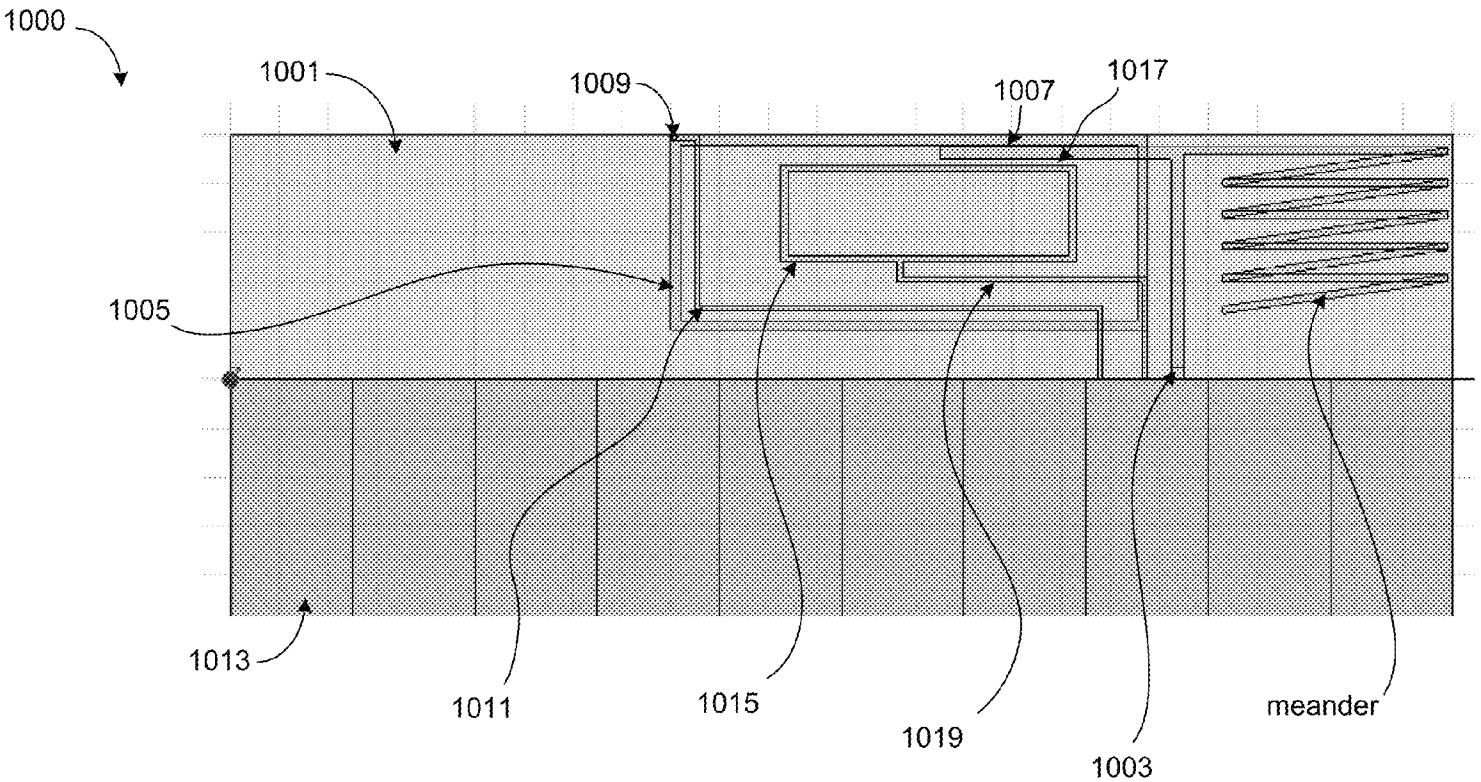
FIG. 10 illustrates a top view of a top layer of a multi-band CRLH antenna device having multiple hollow cell patch structures formed on a substrate, according to an example embodiment.

The concept of the hollow cell patch design presented in the previous embodiments may be applied to multi-band CRLH antenna devices. For example, FIG. 10 illustrates a top view of a top layer of a multi-band CRLH antenna device 1000 having multiple hollow cell patch structures formed on a substrate 1001. In FIG. 10, portions of a first CRLH structure may include several conductive elements that are formed on the substrate 1001. The conductive elements may include, for example, a shared feed line 1003 configured to receive an RF signal, a first cell patch 1005 capacitively coupled to the shared feed line 1003 through a coupling gap 1007, a via 1009, which is formed in the substrate 1001, to couple the first cell patch 1005 to a first via line 1011, and a ground electrode 1013, formed on both surfaces of the substrate and connected together by an array of vias (not shown), the ground electrode 1013 coupled to and terminating the first via line 1011. Portions of a second CRLH structure also include several conductive elements that are formed on the substrate 1001. The conductive elements for the second CRLH structure may include, for example, a shared feed line 1003 configured to receive an RF signal, a second cell patch 1015 capacitively coupled to the shared feed line 1003 through a coupling gap 1017, a second via line 1019 connected to the second cell patch 1015, and the ground electrode 1013 coupled to and terminating the second via line 1019. A meander line 1021 may be coupled to the feed line 1003 to establish an extra resonance.

Figure 11:
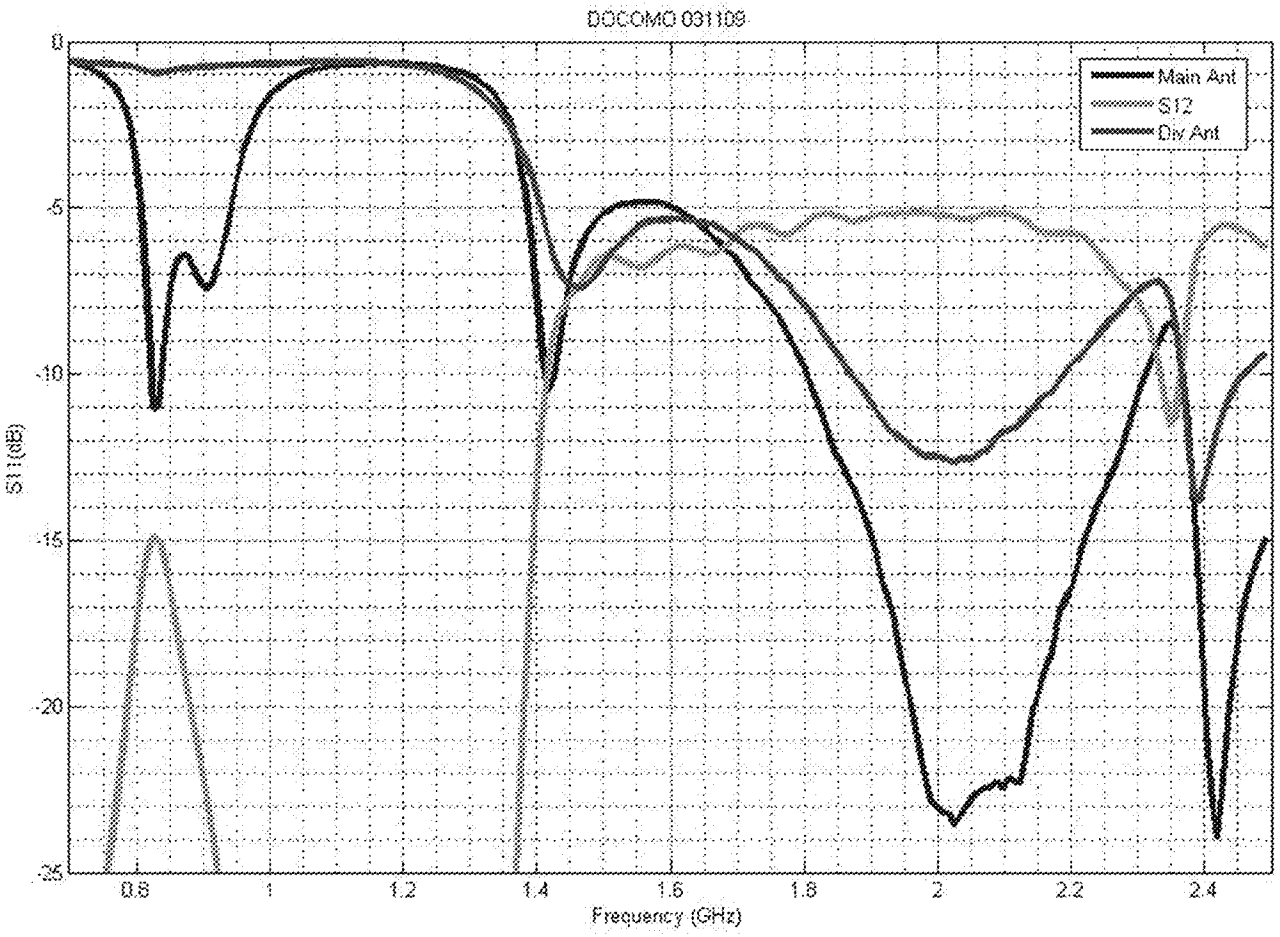
FIG. 11 illustrates a return loss plot for the multi-band CRLH antenna device, according to an example embodiment.

FIG. 11 illustrates a return loss plot for the multi-band CRLH antenna device 1000.

According to this embodiment, multiple CRLH antenna structures are formed on a single substrate to provide multi-band frequency operations. In addition, by applying the hollow cell patch structures in this multi-band CRLH antenna device 1000, a significant amount free space near the hollow cell patch is available for other components or other uses, thereby making the implementation of highly integrated and compact antenna devices simpler and more cost effective.

Figure 12:
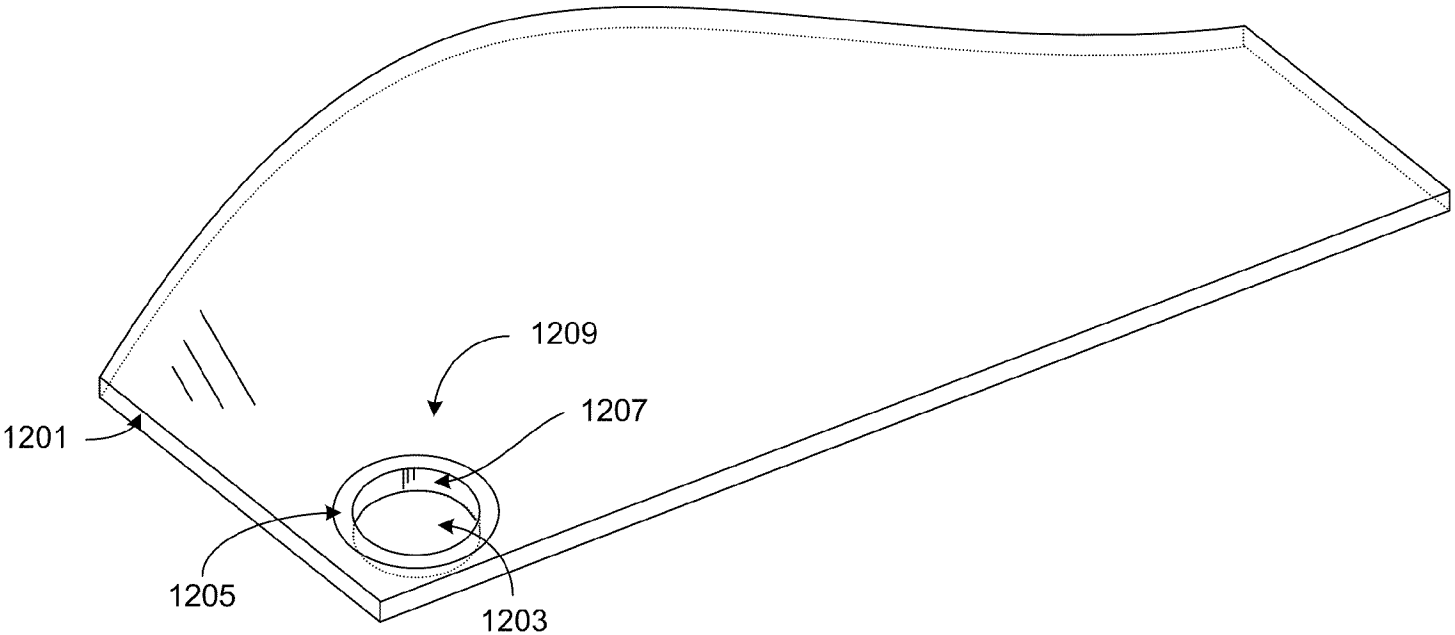
FIG. 12 illustrates an isometric view of an opening formed in a PCB substrate to construct a hollow cell patch, according to an example embodiment.

Another variation of the hollow cell patch design may include a cell patch formed along an opening or hole in the PCB substrate as shown in FIG. 12. Openings in the PCB are generally formed to accommodate mounting brackets or support structures, for example. FIG. 12 illustrates an isometric view of an opening formed in a PCB substrate. Such openings 1203 in the substrate 1201 can be plated to form a conductive surface along the interior sidewall 1207 and along the edge of the sidewall 1205 formed by the opening 1203, forming a hollow cell patch structure 1209 as shown in FIG. 12. Other conductive elements (not shown) supported by the substrate 1201 may be coupled to the hollow cell patch 1209 to form a CRLH antenna structure. In particular, this design offers the advantage of improved antenna integration and space savings by using existing PCB features as part of the antenna design.

Table 1 and Table 2 summarize a description of conductive elements used in a single CRLH antenna structure and a multi-CRLH antenna structures, respectively.

TABLE 1

| Single CRLH Antenna Structure | | |
|---|---|---|
| Parameter | Description | Location |
| Feed Line | Single feed line coupled to a cell patch.<br>May include a meander line extension. | Substrate ($1^{st}$ Surface) |
| Cell Patch | Polygonal shaped and is coupled to feed line through a coupling gap.<br>Features an inner perimeter shape/edge and an outer perimeter shape/edge.<br>Includes an enclosed conductive portion formed along the exterior edge of the cell patch, leaving an interior portion of the cell patch to partially expose the substrate.<br>May be defined by a cell ring, multiple cutouts, and multiple cutouts inside each other. | Substrate ($1^{st}$ Surface) |
| Meander Line Extension (Optional) | Added to the feed line and formed on the substrate. | Substrate ($1^{st}$ Surface) |
| Via Line | Conductive line that connects the cell patch to a bottom ground electrode. | Substrate ($2^{nd}$ Surface) |
| Connecting Vias | Via connects the cell patch to the ground electrode;<br>Via connecting meander line to the feed line; | Substrate (within) |

TABLE 2

| Multi-CRLH Antenna Structure | | |
|---|---|---|
| Parameter | Description | Location |
| Feed Line | Single feed line shared by two cell patches. A stub is attached to the feed line at one end portion and meander line extension is attached to the feed line at another end portion. | Substrate (1st Surface) |
| Cell Patch 1 | Polygonal shaped and is coupled to feed line through a coupling gap. Includes an enclosed conductive portion formed along the exterior edge of the cell patch, leaving an interior portion of the cell patch to partially expose the substrate. Features an inner perimeter shape/edge and an outer perimeter shape/edge. May be defined by a cell ring, multiple cutouts, and multiple cutouts inside each other. | Substrate (1st Surface) |
| Cell Patch 2 | Polygonal shaped and is coupled to feed line through a coupling gap. Includes an enclosed conductive portion formed along the exterior edge of the cell patch, leaving an interior portion of the cell patch to partially expose the substrate. Features an inner perimeter shape/edge and an outer perimeter shape/edge. May be defined by a cell ring, multiple cutouts, and multiple cutouts inside each other. | Substrate (2nd Surface) |
| Meander Line Extension | Added to the feed line and formed on top layer of the substrate. | Substrate (1st Surface) |
| Via Line 1 | Conductive line that connects the first cell patch to a bottom ground electrode. | Substrate (1st Surface) |
| Via Lines 2 | Conductive line that connects the second cell patch to the bottom ground electrode. | Substrate (2nd Surface) |
| Connecting Via | Via connects the cell patch 1 to the via line 1; | Substrate (within) |

Other antenna configurations include variations of the hollow cell patch designs. For example, hollow cell patch designs may include multiple cutouts of varying shapes, multiple rings, multiple cutouts within each other, or a combination thereof. In addition, such designs may be applied to sophisticated CRLH antenna structures, including multiple layers, 3-D or elevated substrates. These designs may support a variety of antenna configuration where space, performance and integration are a necessity.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination. Only a few implementations are disclosed. However, it is understood that variations and enhancements may be made.

What is claimed is what is described and illustrated, including:

1. An wireless device, comprising:

a substrate:

an antenna device formed on the substrate, comprising:

a ground electrode formed on the substrate;

a cell patch, wherein the cell patch comprises an enclosed conductive portion formed along an exterior edge of the cell patch, leaving an interior portion of the cell patch to partially expose the substrate;

a feed structure electromagnetically coupled to the cell patch;

a via line coupled to the ground electrode; and a via coupling the via line to the cell patch.

2. The wireless device of claim 1, wherein the antenna device is a Composite Right and Left Handed (CRLH) structure.

3. The wireless device of claim 2, wherein the CRLH structure supports a plurality of modes as a function of frequency.

4. The wireless device of claim 3, wherein the plurality of modes include a Left-Hand (LH) mode and a Right-Hand (RH) mode.

5. The wireless device of claim 3, further comprising:

a conductive element formed in the interior of the cell patch.

6. The wireless device of claim 5, wherein the conductive element forms an extended meander line.

7. The wireless device of claim 1, wherein the cell is in the form of a polygon.

8. The wireless device of claim 1, wherein the cell patch includes a cell ring, a plurality of cutouts, or plurality of cutouts inside each other.

9. The wireless device of claim 2, wherein the CRLH structure supports a plurality of modes as a function of frequency.

10. The wireless device of claim 1, wherein the substrate is made of a dielectric material, and the antenna device comprises metallic structures.

11. A wireless device, comprising:

a substrate;

a ground electrode supported by the substrate;

a first cell patch formed on a first surface of the substrate, wherein the first cell patch comprises an enclosed conductive portion formed along an exterior edge of the first cell patch, leaving an interior portion of the first cell patch to partially expose the substrate;

a second cell patch formed on a second surface of the substrate, wherein the second cell patch comprises a second enclosed conductive portion formed along an exterior edge of the second cell patch, leaving an interior portion of the second cell patch to partially expose the substrate;

a feed structure electromagnetically coupled to the first and second cell patches;

a first and a second via line, each coupled to the ground electrode, the second via line connected to the second cell patch; and a via coupling the first via line to the first cell patch.

12. The wireless device of claim 10, wherein the antenna device is a Composite Right and Left Hand (CRLH) structure.

13. The wireless device of claim 11, wherein the conductive element forms an extended meander line.

14. The wireless device of claim 11, wherein at least one of the first and second cell patches is in the form of a polygon.

15. The wireless device of claim 11, wherein at least one of the first and second cell patches includes a cell ring, a plurality of cutouts.

16. The wireless device of claim 11, wherein at least one of the first and second cell patches includes a plurality of cutouts inside each other.

17. The wireless device of claim 11, wherein the CRLH structure supports a plurality of modes as a function of frequency.

18. A method, comprising:

forming a ground electrode on a substrate;

forming a cell patch on the substrate, wherein the cell patch comprises an enclosed conductive portion formed along an exterior edge of the cell patch, leaving an interior portion of the cell patch to partially expose a dielectric portion of the substrate;

forming a feed structure electromagnetically coupled to the cell patch;

forming a via line coupled to the ground electrode; and forming a via coupling the via line to the cell patch.

19. The method of claim 18, wherein the CRLH structure supports a plurality of modes as a function.

20. The method of claim 18, further comprising forming an extended meander line in the feed structure on the substrate as a conductive element.

* * * * *